US011274426B2

(12) United States Patent
Alcala

(10) Patent No.: US 11,274,426 B2
(45) Date of Patent: Mar. 15, 2022

(54) PLUMBING SNAKE ASSEMBLY

(71) Applicant: Robert Alcala, Joshua, TX (US)

(72) Inventor: Robert Alcala, Joshua, TX (US)

( * ) Notice: Subject to any disclaimer, the term of this patent is extended or adjusted under 35 U.S.C. 154(b) by 201 days.

(21) Appl. No.: 16/675,381

(22) Filed: Nov. 6, 2019

(65) Prior Publication Data

US 2021/0131085 A1 May 6, 2021

(51) Int. Cl.

| | |
|---|---|
| ***E03C 1/302*** | (2006.01) |
| ***B08B 9/045*** | (2006.01) |
| ***E03F 9/00*** | (2006.01) |
| ***B08B 9/043*** | (2006.01) |

(52) U.S. Cl.

CPC ..... *E03C 1/302* (2013.01); *B08B 9/043* (2013.01); *B08B 9/045* (2013.01); *B08B 9/0436* (2013.01); *E03F 9/005* (2013.01)

(58) Field of Classification Search

CPC ..... E03F 9/002; E03F 9/005; E03C 1/302; B08B 9/04; B08B 9/043; B08B 9/0436; B08B 9/045; B08B 9/047

USPC ..... 15/104.05, 104.09, 104.095, 15/104.31–104.33

See application file for complete search history.

(56) References Cited

U.S. PATENT DOCUMENTS

| | | | | | |
|---|---|---|---|---|---|
| 2,201,733 | A * | 5/1940 | Kollmann | B08B 9/045 | 15/104.33 |
| 2,467,849 | A * | 4/1949 | O'Brien | E03C 1/302 | 15/104.33 |
| 3,457,580 | A * | 7/1969 | Meyers | F28G 15/04 | 15/104.33 |
| 3,727,261 | A * | 4/1973 | Levine | B23B 45/001 | 15/104.33 |
| 4,042,305 | A * | 8/1977 | Vincent | F16B 21/088 | 403/14 |
| 4,364,140 | A * | 12/1982 | Irwin | E03F 9/005 | 15/104.33 |
| 5,107,550 | A | 4/1992 | Hawro | | |
| 6,076,219 | A * | 6/2000 | Irwin | B08B 9/045 | 15/104.33 |
| 9,015,889 | B1 | 4/2015 | Khonsary | | |
| 9,080,599 | B2 * | 7/2015 | Rutkowski | B08B 9/045 | |
| 9,234,342 | B1 | 1/2016 | Beesley | | |
| D830,806 | S | 10/2018 | Gu | | |
| 2007/0089254 | A1 | 4/2007 | Alaine | | |

(Continued)

FOREIGN PATENT DOCUMENTS

WO WO2006019936 2/2006

*Primary Examiner* — Mark Spisich

(57) ABSTRACT

A plumbing snake assembly includes a drill has a handle, a motor housing, a chuck is positioned on the motor housing and a drive unit is positioned within the motor housing. The motor housing has a cable aperture extending therethrough. A plurality of flexible shafts is provided and the flexible shafts can be coupled together to form a plumbing snake for pushing through a drain pipe. Each of the flexible shafts is insertable through the cable aperture in the drill such that the drive unit engages and subsequently rotates the flexible shafts when the drive unit is turned on. A cleaning head is removably attachable to a respective one of the flexible shafts thereby facilitating the cleaning head to be positioned on a leading end of the plumbing snake defined by the flexible shafts. In this way the cleaning head engages and removes a blockage in the drain pipe.

5 Claims, 3 Drawing Sheets

(56) References Cited

U.S. PATENT DOCUMENTS

| | | | | |
|---|---|---|---|---|
| 2010/0017981 | A1* | 1/2010 | Hamm | B08B 9/045 15/104.33 |
| 2011/0182656 | A1* | 7/2011 | Babb | B08B 9/045 403/265 |
| 2014/0115802 | A1 | 5/2014 | Yu | |
| 2018/0369883 | A1* | 12/2018 | Kehoe | E03C 1/302 |

* cited by examiner

PLUMBING SNAKE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to snake devices and more particularly pertains to a new snake device for clearing a blockage from a drain pipe.

(2) Description of Related Art Including Information Disclosed Under 37 CFR 1.97 and 1.98

The prior art relates to snake devices.

BRIEF SUMMARY OF THE INVENTION

An embodiment of the disclosure meets the needs presented above by generally comprising a drill has a handle, a motor housing, a chuck is positioned on the motor housing and a drive unit is positioned within the motor housing. The motor housing has a cable aperture extending therethrough. A plurality of flexible shafts is provided and the flexible shafts can be coupled together to form a plumbing snake for pushing through a drain pipe. Each of the flexible shafts is insertable through the cable aperture in the drill such that the drive unit engages and subsequently rotates the flexible shafts when the drive unit is turned on. A cleaning head is removably attachable to a respective one of the flexible shafts thereby facilitating the cleaning head to be positioned on a leading end of the plumbing snake defined by the flexible shafts. In this way the cleaning head engages and removes a blockage in the drain pipe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
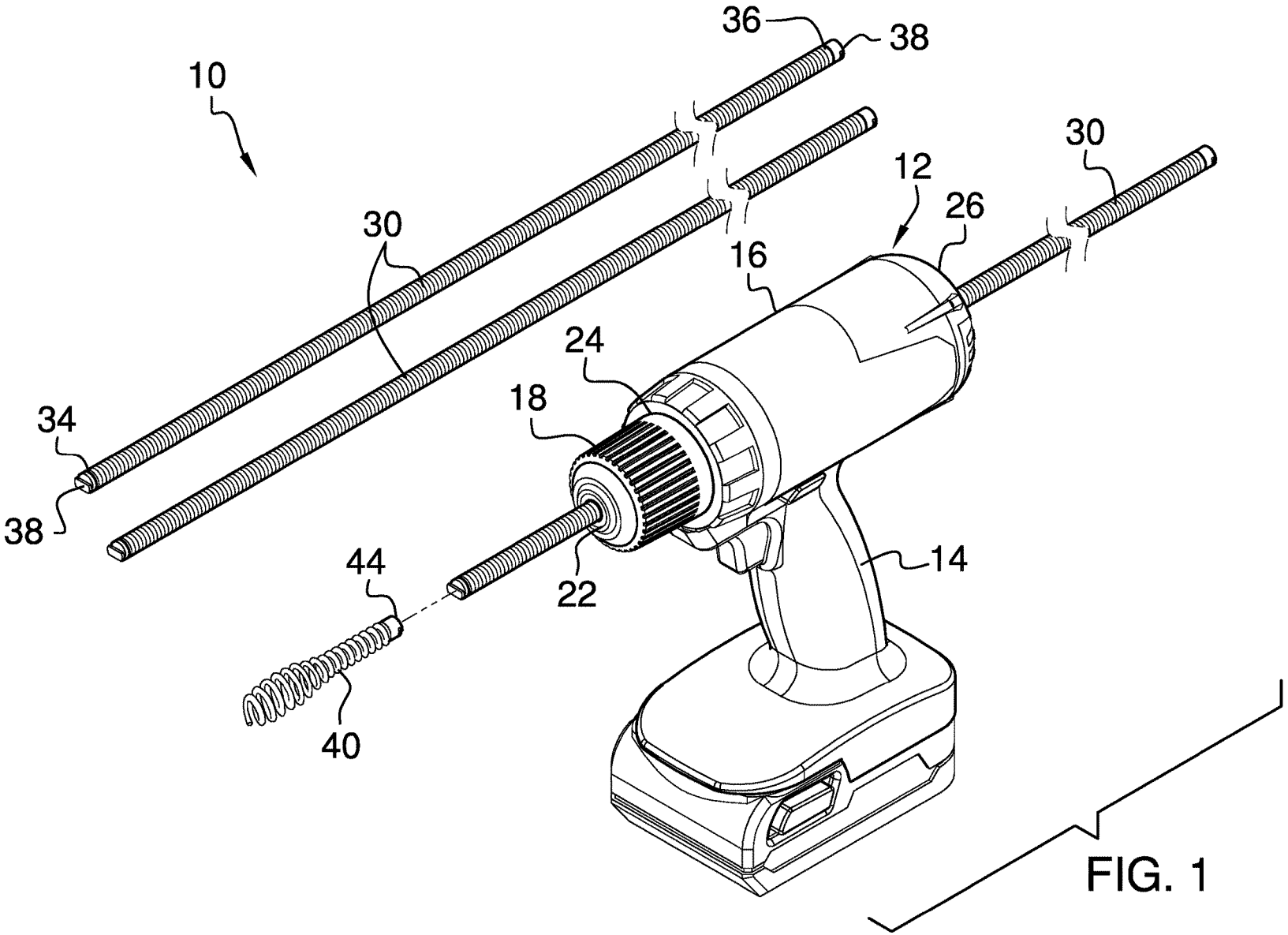
FIG. 1 is a perspective view of a plumbing snake assembly according to an embodiment of the disclosure.
Figure 2:
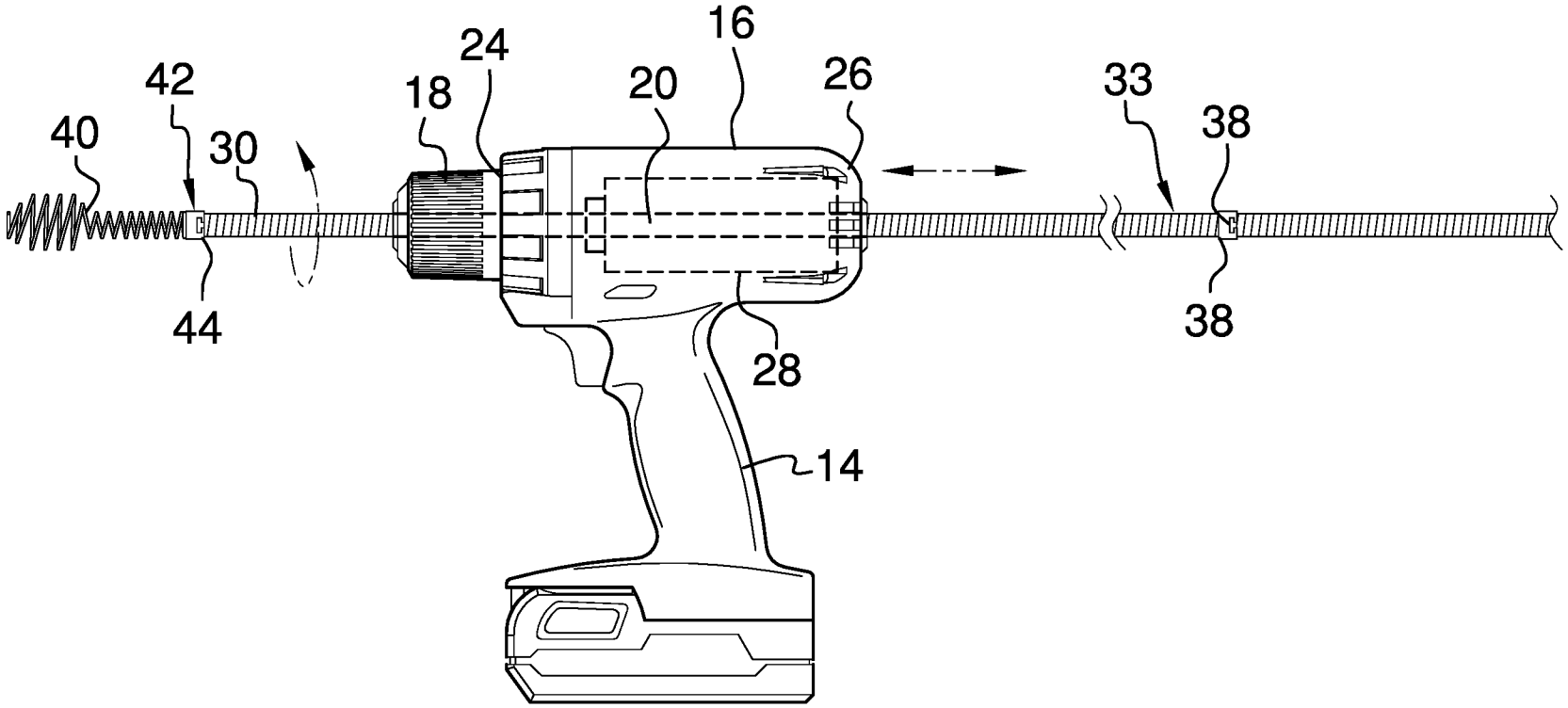
FIG. 2 is a left side phantom view of an embodiment of the disclosure.
Figure 3:
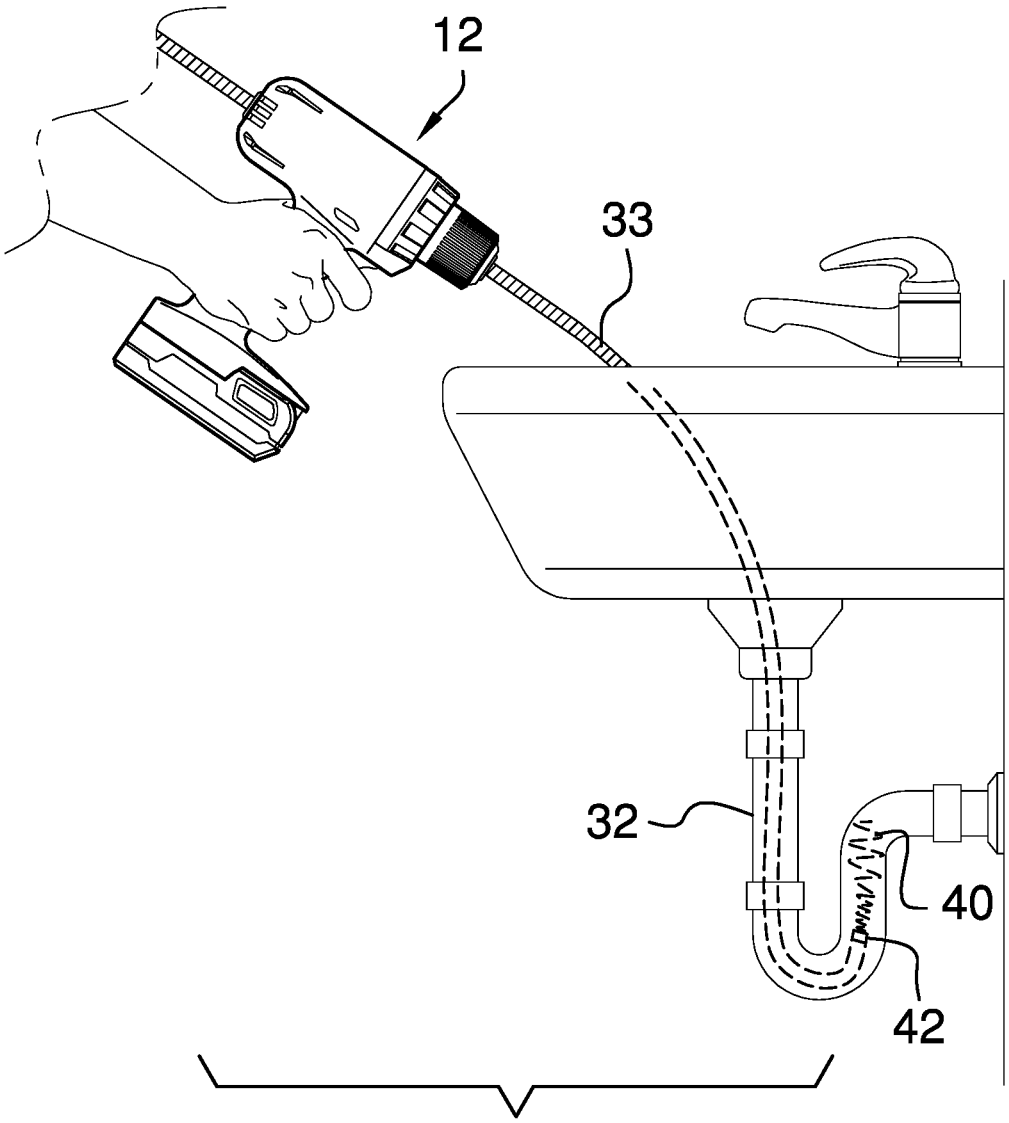
FIG. 3 is a perspective in-use view of an embodiment of the disclosure.

With reference now to the drawings, and in particular to FIGS. 1 through 3 thereof, a new snake device embodying the principles and concepts of an embodiment of the disclosure and generally designated by the reference numeral 10 will be described.

As best illustrated in FIGS. 1 through 3, the plumbing snake assembly 10 generally comprises a drill 12 that has a handle 14, a motor housing 16 and a chuck 18 that is positioned on the motor housing 16. The motor housing 16 has a cable aperture 20 extending therethrough and the cable aperture 20 is aligned with an opening 22 in the chuck 18. The drill 12 may be a cordless drill, a corded drill or any other type of electric drill. The motor housing 16 has a front end 24 and a back end 26, and the chuck 18 is positioned on the front end 24. Moreover, the cable aperture 20 extends through the back end 26 and the front end 24.

The drill 12 includes a drive unit 28 that is positioned within the motor housing 16. The drive unit 28 has an axis of rotation that is aligned with an axis extending through the front end 24 and the back end 26 of the motor housing 16. Additionally, the cable aperture 20 extends through the drive unit 28. The drive unit 28 rotates in a first direction or a second direction when the drive unit 28 is turned on. The drive unit 28 may include an electric motor and a worm gear that is rotated by the electric motor.

A plurality of flexible shafts 30 is provided and each of the flexible shafts 30 is comprised of a resiliently bendable material. In this way each of the flexible shafts 30 can be pushed through a drain pipe 32. The flexible shafts 30 are removably attachable together to define a plumbing snake 33. Additionally, each of the flexible shafts 30 is insertable through the cable aperture 20 in the drill 12. In this way the drive unit 28 engages and subsequently rotates the flexible shafts 30 when the drive unit 28 is turned on. Each of the flexible shafts 30 may comprise a coiled spring which can be engaged by the worm gear in the drive unit 28.

The drive unit 28 urges the flexible shafts 30 forwardly through the motor housing 16 and the chuck 18 when the drive unit 28 rotates in the first direction. In this way the flexible shafts 30 can be urged into the drain pipe 32 for clearing a blockage in the drain pipe 32. The drain pipe 32 may be a drain pipe in a residential plumbing system, a drain pipe in a commercial plumbing system or any other type of fluid drain pipe that can potentially become clogged. The drive unit 28 urges the flexible shafts 30 rearwardly through the motor housing 16 and the chuck 18 when the drive unit 28 rotates in the second direction. In this way the flexible shafts 30 can be removed from the drain pipe 32.

Each of the flexible shafts 30 has a first end 34 and a second end 36, and each of the flexible shafts 30 includes a pair of engagements 38. Each of the engagements 38 is positioned on a respective one of the first end 34 and the second end 36. Moreover, each of the engagements 38 on the flexible shafts 30 releasably engages a respective engagement 38 on an adjacent flexible shaft 30 for attaching the flexible shafts 30 together. Each of the engagements 38 may comprise a magnet, a set of complementary male and female fasteners or any other type of releasable fastener.

A cleaning head 40 is provided and the cleaning head 40 is removably attachable to a respective one of the flexible shafts 30. In this way the cleaning head 40 can be positioned on a leading end 42 of the plumbing snake 33 defined by the flexible shafts 30. Thus, the cleaning head 40 can engage and remove a blockage in the drain pipe 32. The cleaning head 40 includes an engagement 44 and the engagement 44 on the cleaning head 40 releasably engages a respective engagement 38 on the respective flexible shaft 30 to which the cleaning head 40 is attached. The cleaning head 40 may comprise a coiled spring that is stretched apart to define a plurality of spaced loops.

In use, a pre-determined number of the flexible shafts 30 is attached together to define the plumbing snake 33 and the plumbing snake 33 is fed through the cable aperture 20 in the drill 12. Thus, the drive unit 28 engages and subsequently urges the plumbing snake 33 forwardly or rearwardly for routing through the drain pipe 32. The parallel orientation of the drive unit 28 with respect to the cable aperture 20 facilitates the plumbing snake 33 to be urged through the drill 12 without the problem of a free end of the plumbing snake 33 flopping around. The flexible shafts 30 can be attached together one by one as they are each fed through the drill 12, or the flexible shafts 30 can be attached together prior to being fed through the drill 12. In this way a user can employ the plumbing snake 33 in an enclosed space with limited working area or in an open space with unlimited working area.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A plumbing snake assembly being configured to insert or retract a plumbing snake into a drain using a drill, said assembly comprising:

a drill having a handle, a motor housing, a chuck being positioned on said motor housing and a drive unit being positioned within said motor housing, said motor housing having a cable aperture extending therethrough, said cable aperture being aligned with said drive unit and with an opening in said chuck;

a plurality of flexible shafts, each of said flexible shafts being comprised of a resiliently bendable material wherein each of said flexible shafts is configured to be pushed through a drain pipe, said flexible shafts being removably attachable together to define a plumbing snake, each of said flexible shafts being insertable through said cable aperture in said drill such that said drive unit engages and subsequently rotates said flexible shafts when said drive unit is turned on, each of said flexible shafts having a first end and a second end, each of said flexible shafts including a pair of engagements, each of said engagements being positioned on a respective one of said first end and said second end, each of said engagements on said flexible shafts releasably engaging a respective engagement on an adjacent flexible shaft for attaching said flexible shafts together, said pair of engagements including a T-shaped projection and a complementary shaped groove extending perpendicular to a longitudinal axis of the respective flexible shaft wherein rotation is transferred between the T-shaped projection engaged to the complementary shaped groove of the adjacent flexible shaft the T-shaped projection defined by a first planar portion and a second planar portion bisected by the first planar portion with the second planar portion extending across the width of the shaft end; and a cleaning head being removably attachable to a respective one of said flexible shafts thereby facilitating said cleaning head to be positioned on a leading end of said plumbing snake defined by said flexible shafts wherein said cleaning head is configured to engage and remove a blockage in the drain pipe.

2. The assembly according to claim 1, wherein said motor housing has a front end and a back end, said chuck being positioned on said front end, said cable aperture extending through said back end and said front end, said drive unit having an axis of rotation being aligned with an axis extending through said front end and said back end of said motor housing, said cable aperture extending through said drive unit.

3. The assembly according to claim 1, wherein said drive unit rotates in a first direction or a second direction when said drive unit is turned on, said drive unit urging said flexible shafts forwardly through said motor housing and said chuck when said drive unit rotates in said first direction wherein said flexible shafts are configured to be urged into a drain pipe for clearing a blockage in the drain pipe, said drive unit urging said flexible shafts rearwardly through said motor housing and said chuck when said drive unit rotates in said second direction wherein said flexible shafts are configured to be removed from the drain pipe.

4. The assembly according to claim 1, wherein said cleaning head includes an engagement, said engagement on said cleaning head releasably engaging a respective engagement on said respective flexible shaft to which said cleaning head is attached.

5. A plumbing snake assembly being configured to insert or retract a plumbing snake into a drain using a drill, said assembly comprising:

a drill having a handle, a motor housing and a chuck being positioned on said motor housing, said motor housing having a cable aperture extending therethrough, said cable aperture being aligned with an opening in said chuck, said motor housing having a front end and a back end, said chuck being positioned on said front end, said cable aperture extending through said back end and said front end, said drill including a drive unit being positioned within said motor housing, said drive unit having an axis of rotation being aligned with an axis extending through said front end and said back end of said motor housing, said cable aperture extending through said drive unit, said drive unit rotating in a first direction or a second direction when said drive unit is turned on;

a plurality of flexible shafts, each of said flexible shafts being comprised of a resiliently bendable material wherein each of said flexible shafts is configured to be pushed through a drain pipe, said flexible shafts being removably attachable together to define a plumbing snake, each of said flexible shafts being insertable through said cable aperture in said drill such that said drive unit engages and subsequently rotates said flexible shafts when said drive unit is turned on, said drive unit urging said flexible shafts forwardly through said motor housing and said chuck when said drive unit rotates in said first direction wherein said flexible shafts are configured to be urged into a drain pipe for clearing a blockage in the drain pipe, said drive unit urging said flexible shafts rearwardly through said motor housing and said chuck when said drive unit rotates in said second direction wherein said flexible shafts are configured to be removed from the drain pipe, each of said flexible shafts having a first end and a second end, each of said flexible shafts including a pair of engagements, each of said engagements being positioned on a respective one of said first end and said second end, each of said engagements on said flexible shafts releasably engaging a respective engagement on an adjacent flexible shaft for attaching said flexible shafts together, said pair of engagements including a T-shaped projection and a complementary shaped groove extending perpendicular to a longitudinal axis of the respective flexible shaft wherein rotation is transferred between the T-shaped projection engaged to the complementary shaped groove of the adjacent flexible shaft the T-shaped projection defined by a first planar portion and a second planar portion bisected by the first planar portion with the second planar portion extending across the width of the shaft end; and a cleaning head being removably attachable to a respective one of said flexible shafts thereby facilitating said cleaning head to be positioned on a leading end of said plumbing snake defined by said flexible shafts wherein said cleaning head is configured to engage and remove a blockage in the drain pipe, said cleaning head including an engagement, said engagement on said cleaning head releasably engaging a respective engagement on said respective flexible shaft to which said cleaning head is attached.

* * * * *